United States Patent [19]

Tsuyuki et al.

[11] Patent Number: 5,068,517

[45] Date of Patent: Nov. 26, 1991

[54] PRINTED STRIP HEATER

[75] Inventors: Takao Tsuyuki; Shigehiro Sato, both of Yokohama; Tetsuo Ootani, Yokosuka, all of Japan

[73] Assignee: Toshiba Lighting & Technology Corporation, Tokyo, Japan

[21] Appl. No.: 396,700

[22] Filed: Aug. 22, 1989

[30] Foreign Application Priority Data

| | | | |
|---|---|---|---|
| Aug. 25, 1988 | [JP] | Japan | 63-211401 |
| Aug. 30, 1988 | [JP] | Japan | 63-215734 |
| Nov. 9, 1988 | [JP] | Japan | 63-282777 |
| Nov. 22, 1988 | [JP] | Japan | 63-295671 |

[51] Int. Cl.[5] ..... H05B 3/26

[52] U.S. Cl. ..... 219/543; 219/553

[58] Field of Search ..... 346/76 PH; 219/505, 219/543, 504

[56] References Cited

U.S. PATENT DOCUMENTS

| | | | |
|---|---|---|---|
| 3,478,191 | 11/1969 | Johnson et al. | 346/76 PH |
| 3,961,155 | 6/1976 | Weldon | 219/543 |
| 4,130,752 | 12/1978 | Conta | 219/543 |
| 4,258,740 | 3/1981 | Kaartinen | 219/543 |
| 4,259,564 | 3/1981 | Ohkubo | 219/543 |
| 4,574,292 | 3/1986 | Takikawa et al. | 219/543 |
| 4,679,056 | 7/1987 | Kobayashi et al. | 219/504 |
| 4,755,659 | 7/1988 | Leon | 219/543 |
| 4,795,887 | 1/1989 | Myokan | 219/543 |
| 4,849,611 | 7/1989 | Whitney | 219/543 |
| 4,864,106 | 9/1989 | Lorenz | 219/543 |

FOREIGN PATENT DOCUMENTS

| | | |
|---|---|---|
| 1816105 | 6/1973 | Fed. Rep. of Germany . |
| 3247224 | 7/1983 | Fed. Rep. of Germany . |
| 3545267 | 6/1987 | Fed. Rep. of Germany . |

OTHER PUBLICATIONS

Patent Abstracts of Japan, Unexamined Applications, M Section, vol. 3, No. 35, Mar. 24, 1979, p. 154 M 53, Kokai-no. 54-13-031.

Patent Abstracts of Japan, Unexamined Applications, M Section, vol. 3, No. 116, Sep. 27, 1979, p. 13 M 74, Kokai-no. 54-89 344.

*Primary Examiner*—Teresa J. Walberg

*Attorney, Agent, or Firm*—Cushman, Darby & Cushman

[57] ABSTRACT

A printed strip heater for heating an object includes a heat resistive substrate, a strip of electrically conductive material mounted on the substrate and terminal sections for providing electrical energy to the strip.

35 Claims, 6 Drawing Sheets

PRINTED STRIP HEATER

FIELD OF THE INVENTION

The present invention relates generally to a printed strip heater for heating an object, and more particularly, to a printed strip heater for heating an object suitable for manufacturing by a thick film technique.

BACKGROUND OF THE INVENTION

In a field of strip heaters or line heaters, a coil hearer constituted by a nichrome filament and a lamp heater, such as an infrared ray lamp, which is shaped into a long straight line are conventionally used.

The coil heater, however, has a drawback that it is difficult to reduce the thickness of the coil heater. Thus, the coil heater is not suitable for the use in a narrow place. Further, the coil heater is weak when subjected to mechanical stress.

The lamp heater also has the drawback that it is difficult to reduce the thickness of the lamp heater. Thus, the lamp heater is nor suitable for the use in a narrow place. Further, the lamp heater does not quickly reach a stable operation state when power is applied thereto.

SUMMARY OF THE INVENTION

It is, therefore, an object of the present invention to provide a printed strip heater for heating an object which is thin in size.

Another object of the present invention is to provide a printed strip heater for heating an object which is resistant to mechanical stresses.

Still another object of the present invention is to provide a printed strip heater for heating an object which is able to reach quickly a stable operation state just after power is applied thereto.

In order to achieve the above object, a printed strip heater for heating an object includes a heat resistive substrate, a strip of electrically conductive material mounted on the substrate and terminal sections for providing electrical energy to the strip.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
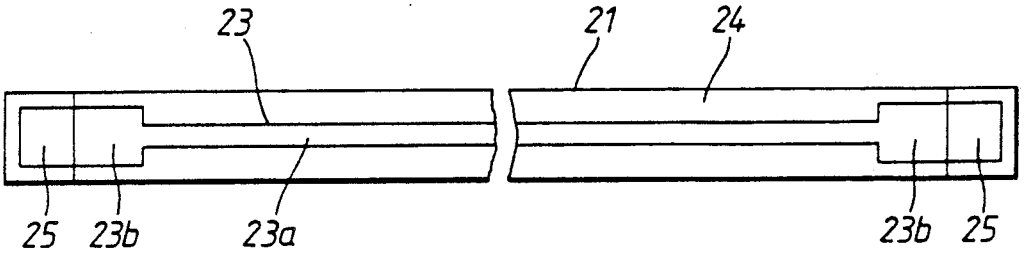
FIG. 1 is a plan view showing a first embodiment of the printed strip heater for heating an object according to the present invention.
Figure 2:
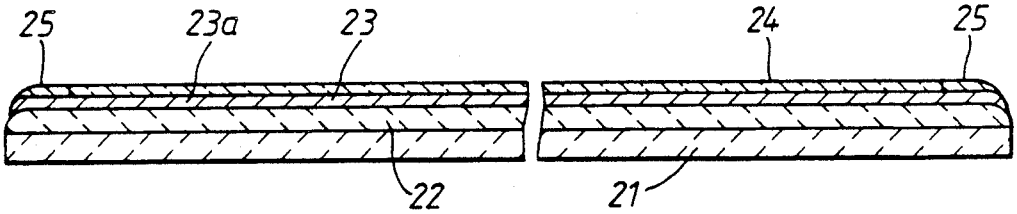
FIG. 2 is a longitudinal sectional view of the printed strip heater for heating an object shown in FIG. 1.

The present invention will be described in detail with reference to the FIGS. 1 through 20. Throughout the drawings, like or equivalent reference nemerals or letters are used to designate like or equivalent elements for simplicity of explanation. In FIGS. 1 and 2, the first embodiment of the printed strip heater comprises a substrate 21 made of alumina ceramic, a glaze layer 22, a strip heater element 23 and a protection layer 24 made of glass. The substrate 21 has a long and slender strip configuration, being 300 mm long, 8 mm wide and 1 mm thick. The glaze layer 22 is formed on the substrate 21. The strip heater element 23 is formed on the glaze layer 22 by a conventional thick film printing technique. The protection layer 24 is coated so as to cover the strip heater element 23 and the glaze layer 22.

Figure 3:
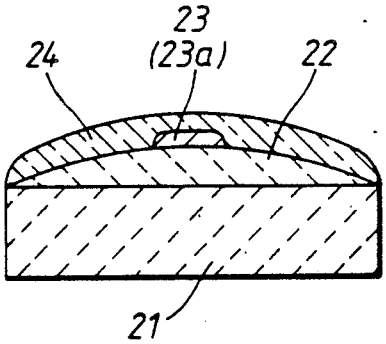
FIG. 3 is an expanded cross-sectional view of the printed strip heater for heating an object shown in FIG. 1.

The thickness of the glaze layer 22 is gradually increased toward its center along the longitudinal direction, as shown in FIG. 3. FIG. 3 as well as FIG. 2 show longitudinal and transverse sections of the printed strip heater in exaggeration. The center portion with the maximum thickness, e.g., about 100 $\mu$ is made uniform and continuous over the almost the entire length of the glaze layer 22.

The strip heater element 23 is made of only silver-palladium alloy (Ag.Pd), or a mixture of the silver-palladium alloy (Ag.Pd) and ruthenium oxide ($Ru.O_2$). The silver-palladium alloy (Ag.Pd) or the mixture is printed on the glaze layer 22 and baked. The strip heater element 23 comprises a heating section 23*a* and a pair of terminal sections 23*b*. The heating section 23*a* has a long and slender strip configuration of 270 mm long, 1.5–2.5 mm wide and 10 $\mu$ thick. Each of the terminal sections 23*b* has a rectangular shape of about 6–7 mm wide and 15 mm long and 10 $\mu$ thick. The terminal sections 23*b* are continuously formed adjacent both ends of the strip heater element 23. Further, conductive layers 25 are coated on the terminal sections 23*b*, respectively. The conductive layers 25 are made of silver for connecting with lead wires.

The protection layer 24 is formed on the strip heater element 23 and a portion of the glaze layer 22 exposed outside of the strip heater element 23. The protection layer 24 is formed by coating with, for instance, frit glass and backing the frit glass. Almost the entire surface of the heating element except for conductive layers 25 is uniformly covered by protection layer 24 at a thickness of about 10 $\mu$.

The outer surface of the protection layer 24 is gradually raised in a smooth, gentle circular arc shape toward its center along the transverse direction, as shown in FIG. 3. As a result, the center portion of the protection layer 24, which covers the strip heater element 23, has been formed higher than other portions. Furthermore, the height portion is made uniform and continuous along the longitudinal direction, as shown in FIG. 2.

An operation of the first embodiment of the printed strip heater according to the present invention will be described in detail.

The heating section 23*a* of the strip heater element 23 generates heat, when power is supplied across the terminal sections 23*b* through lead wires (not shown) connected to the conductive layers 25. The heating operation of the heating section 23*a* quickly reaches its stable operating state, because the heating section 23*a* itself generates the heat in response to the power applied thereto. The protection layer 24 has a relatively thin thickness, e.g., a thickness of about 10 $\mu$. Thus, the heat generated by the heating section 23*a* is also transmitted quickly to the outer surface of the protection layer 24.

Next, the operation of the first embodiment of the printed strip heater will be described with reference to a printed strip heater provided in copying machines for fixing images on paper. The outer surface to the protection layer 24 is formed in the gentle and smooth circular arc shape in the transverse direction of the printed strip heater, as described above (see FIG. 3). Thus, a paper with an unfixed image can move smoothly in the transverse direction of the printed strip heater while keeping contact with the printed strip heater, i.e., the protection layer 24. The image is fixed on the paper by the heat of the strip heater element 23, during the movement of the paper.

As the outer surface of the protection layer 24 is made gentle and smooth, the paper is securely kept in contact with the printed strip heater during the movement. Further, as the center portion of the protection layer 24 is uniform and continuous along the longitudinal direction of the printed strip heater, almost the entire length of the printed strip heater is closely kept in contact with the paper. Therefore, the image is distinctly fixed on the paper without causing blurring. Furthermore, the paper passes the printed strip heater without jamming.

The following table is a result of tests carried out for examining the first embodiment of the printed strip heater for use in copying machines. In the test, the frequency of paper jamming was examined using a sample of the printed strip heater according to the present invention and another sample of a conventional lamp heater. These samples were set in the same copying machine. The frequency of paper jamming was then examined for 1000 sheets of paper for each sample.

| | Printed strip heater (Invention) | Lamp Heater (Prior Art) |
|---|---|---|
| Frequency of Paper Jammings | $\frac{0}{1000}$ | $\frac{20}{1000}$ |

Figure 4:
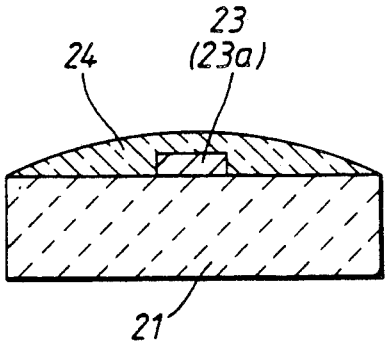
FIG. 4 is an expanded cross-sectional view showing a first embodiment of the printed strip heater for heating an object according to the present invention.

It can be seen from the table that the first embodiment of the printed strip heater according to the present invention is particularly effective in reducing paper jams. In FIG. 4, a second embodiment of the printed strip heater has no glaze layer so the strip heater element 23 is directly formed on a substrate 21. The substrate 21 is made of a ceramic with a low heat conductivity, e.g., a porcelain ceramic. Other portions or elements are the same as the first embodiment of the printed strip heater shown in FIGS. 1, 2 and 3.

According to the second embodiment shown in FIG. 4, the heating operation of the printed strip heater quickly reaches its stable operation state. Further, paper can move smoothly in the transverse direction keeping contact with the printed strip beater without causing blurring and paper jamming.

In the first and second embodiments, the strip heater element 23 is provided at the center in the transverse direction of the substrate 21 or the glaze layer 22. However, the location of the strip heater element 23 is not limited to the center. That is, the strip heater element 23 may be provided at any position in the transverse direction of the substrate 21 or the glaze layer 22. In this case, the protection layer 24 should be formed so that a portion corresponding to the strip heater element 23 is higher than the other portions.

Figure 5:
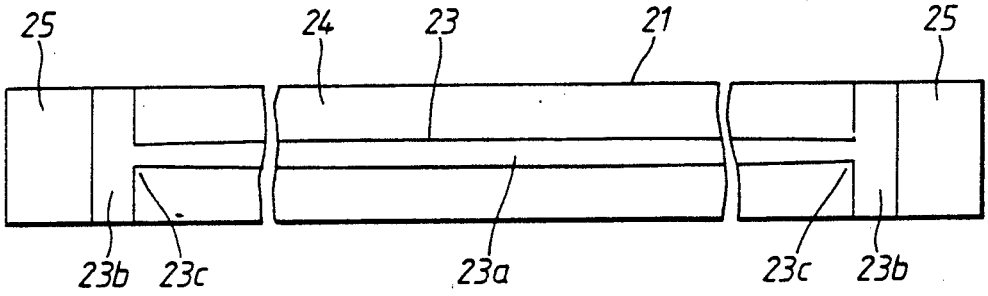
FIG. 5 is a plan view showing a third embodiment of the printed strip heater for heating an object according to the present invention.
Figure 6:
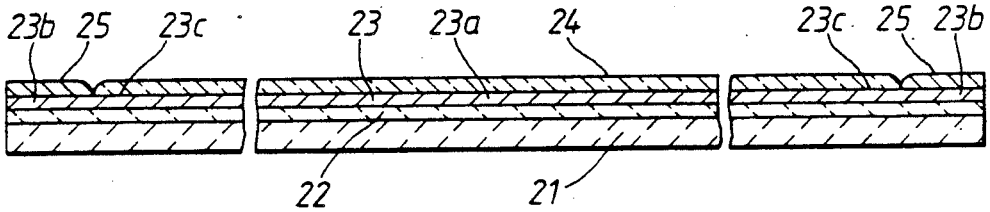
FIG. 6 is a cross-sectional view of the printed strip heater for heating an object shown in FIG. 5.
Figure 7:
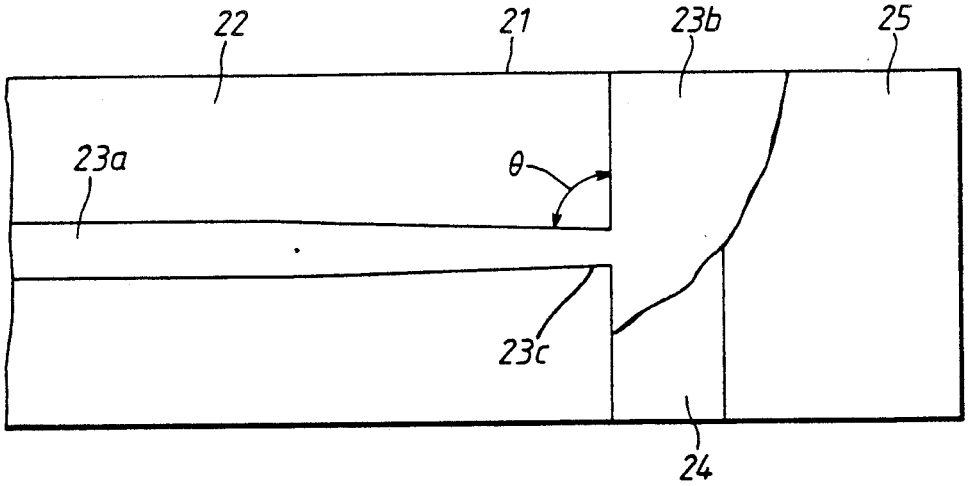
FIG. 7 is an enlarged plan view of a part of the printed strip heater for heating an object shown in FIG. 5.

Further, in the above embodiments, the glaze layer 22 and the protection layer 24 are formed in a circular arc shape in section along the transverse direction. However, the glaze layer 22 and/or the protection layer 24 can be formed in a trapezoid shape or a stepped terrace shape section. Furthermore, the substrate 21 may be formed in triangular shape in section and the strip heater element 23 can be provided on its edge Furthermore, the protection layer 24 can be removed so that the strip heater element is exposed. In FIGS. 5–7, a third embodiment of the printed strip heater comprises a substrate 21 made of alumina ceramic, a glaze layer 22, a strip heater element 23 and a protection layer 24 made of glass. The substrate 21 has a long and slender strip configuration. The glaze layer 22 is formed on the substrate 21. The strip heater element 23 is formed on the glaze layer 22 by a conventional thick film printing technique.

The strip heater element 23 is formed on the glaze layer 22 by printing powder of silver palladium alloy according to a conventional screen printing technique and baking. The strip heater element 23 comprises a heating section 23a and a pair of terminal sections 23b. The heating section 23a has a long and slender strip configuration. Each of the terminal sections 23b has a rectangular shape. The terminal sections 23b are continuously formed adjacent both ends of the strip heater element 23. The protection layer 24 is coated so as to cover the heating section 23a and the glaze layer 22. The protection layer 24 extends over parts of the terminal sections 23a adjacent both ends of the heating section 23a. Other portions of the terminal sections 23b are coated by conductive layers 25. The conductive layers 25 are made of silver for connecting with lead wires. The silver conductive layers 25 and the protection layer 24 are baked together.

The heating section 23a is further shaped as shown in FIG. 7. With the width of the heating section 23a being narrowed gradually when getting nearer the terminal sections 23a. Thus, the angle $\theta$ of a corner 23c between the heating section 23a and the terminal section 23b makes an acute angle. Therefore, portions of the heating section 23a around the corner 23c have a resistance higher than the center portion of the heating section 23a because the portions around the corners 23c are narrower than the enter portion.

The sizes of various sections of this printed strip heater are as follows:

| | |
|---|---|
| Length of substrate 21 | 308 mm |
| Width of substrate 21 | 10 mm |
| Thickness of substrate 21 | 1.5-2 mm |
| Thickness of glaze layer 22 | 5-25 $\mu$ |
| Length of strip heater element 23 | 300 mm |
| Maximum width of heating section 23a | 2.5 mm |
| Minimum width of heating section 23a (corner 23c) | 1.0 mm |
| Width of terminal sections 23b | 10 mm |
| Thickness of strip heater element 23 (uniform) | 10 $\mu$ |

The operation of the third embodiment of the printed strip heater according to the present invention will be described. When power is applied across the terminal sections 23b through lead wires (not shown) coupled to the conductive layers 25, the heating section 23a generates heat. The heat is transferred to the protection layer 24. As the width 2.5 mm of the central portion of the heating section 23a is wider than the width 1.5 mm of the end portions around the corner 23c, both end portions of the heating section 23a generate more heat than the central portion of the heating section 23a.

If the width of heating section 23a is uniform over the entire length, each portion of the heating section 23a generates heat uniformly. However, the heats generated at the end portions of the heating section 23a is easily absorbed by the terminal sections 23b of the strip heater element 23. Thus, the heat obtained at the portions of the protection layer 24 corresponding to the end portions of the heating section 23a becomes lower than the heat obtained at the portion corresponding to the central portion of the heating section 23a in this case.

According to the third embodiment of the printed strip heater, the end portions of the heating section 23a generate more heat than the central portion of the heating section 23a. The heat at the end portions of the heating section 23a compensate for the thermal loss caused by the terminal sections 23b. Thus, the heat obtained at each portion of the protection layer 24 becomes uniform. Accordingly, the third embodiment of the printed strip heater is able to use almost the entire length of the heating section 23a as the effective length of heater with uniform temperature.

Further, although the angle $\theta$ of the corner 23c is made in the acute angle in the third embodiment of the printed strip heater, the angle $\theta$ can be made in the right angle (90°) by curving the edge lines of the end portions of the heating section 23a. If the angle of the corner 23c is too small, the temperature change along a longitudinal direction of the heater becomes steep. Such a steep change of temperature along the heater can cause a disconnection of the heating section 23a due to thermal stress. However, the third embodiment of the printed strip heater can prevent such a disconnection of the heating section 23a.

In the third embodiment the strip heater element 23 is provided at the center in the transverse direction of the substrate 21 or the glaze layer 22. However, the location of the strip heater element 23 is not limited to the center. That is, the strip heater element 23 may be provided at any position in the transverse direction aside the substrate 21 or the glaze layer 22. In that case, the protection layer 24 is formed so that a portion corresponding to the strip heater element 23 is higher than other portions.

Further, in the third embodiment the glaze layer 22 may be removed like the second embodiment shown in FIG. 4. The protection layer 24 can also be removed so that the strip heater element is exposed.

Figure 8:
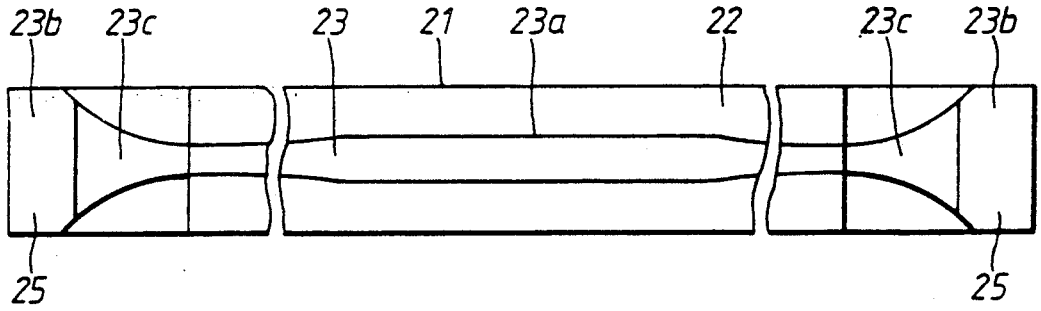
FIG. 8 is a plan view of a fourth embodiment of the printed strip heater for heating an object according to the present invention.
Figure 9:
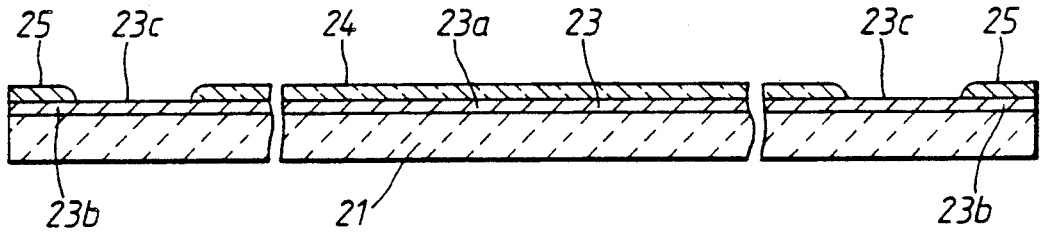
FIG. 9 is a cross-sectional view of the printed strip heater for heating an object shown in FIG. 8.
Figure 10:
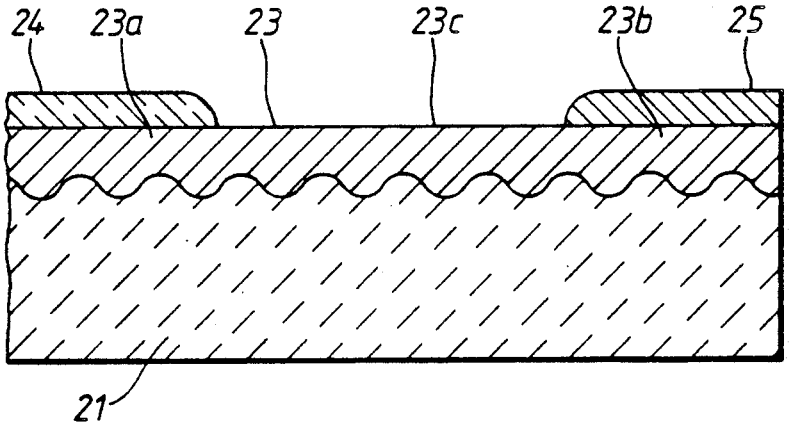
FIG. 10 is an enlarged cross-sectional view of the printed strip heater for heating an object shown in FIG. 8.

Further, the width of each of the terminal sections 23b may be made narrower than the width of the substrate 21. In this case, it is satisfactory if the resistance of the terminal sections 23b is sufficiently lower than the resistance of the heating section 23a and the resistance of the end portions of the heating section 23a is suitably higher than the resistance of the central portion of the heating section 23a. In FIGS. 8-10, a fourth embodiment of the printed strip heater comprises a substrate 21 made of mullite ceramic, a strip heater element 23, a protection layer 24 and a pair of conductive layers 25.

The mullite ceramic constituting the substrate 21 has a chemical composition of $Al_2O_3.2SiO_2$ and physical qualities similar to both ceramics and glass, e.g., a thermal conductivity about 3 kcal/mh ° C., which is of about half of that of alumina ceramic. The mullite ceramics is easy to mechanically process, but has a sufficient mechanical strength. The substrate 21 has a long and slender strip configuration and is 300 mm long, 8 mm wide and 1 mm thick. The surface of the substrate 21 is uneven with many fine depressions of about micron order depth, as shown in FIG. 10.

The strip heater element 23 is formed on the substrate 21 by a conventional thick film printing technique. The uneven surface of the substrate 21 makes the connection between the strip heater element 23 and the substrate 21 firm. The strip heater element 23 is formed by printing powder of silver palladium alloy according to a conventional screen printing technique and baked. The strip heater element 23 comprises a heating section 23a, a pair of boundary sections 23c and a pair of terminal sections 23b.

The heating section 23a has a long and slender strip configuration. The heating section 23a is covered with the protection layer 24. Each of the terminal sections 23b has a rectangular shape. The terminal sections 23b are covered with the conductive layers 25. The boundary sections 23c couple the heating section 23a to the terminal sections 23b. The width of each of the boundary sections 23c gradually increases in the direction from the heating section 23a to the terminal sections 23a, as shown in FIG. 8. The conductive layers 25 are made of silver for connecting with lead wires. The silver conductive layers 25 and the protection layer 24 are baked together.

The sizes of various sections of this printed strip heater are shown as follows:

| | |
|---|---|
| Length of Heating Section 23a | about 270 mm |
| Maximum width of Heating Section 23a (central portion) | about 2.5-3.0 mm |
| Minimum width of Heating Section 23a (end portion) | about 1.5 mm |
| Length of Boundary section 23c | about 8-10 mm |
| Length of Terminal section 23b | about 5 mm |
| Width of Terminal section 23b | about 10 mm |

The strip heater element 23 has a uniform thickness of about 10 μ over the entire length, i.e., over all of the heating section 23a, the boundary sections 23c and the terminal sections 23b.

The width of each of the boundary sections 23c gradually changes, as described above. Thus, the resistances of the boundary sections 23c are gradually reduced in the longitudinal direction of the heater.

Now, the operation of the fourth embodiment of the printed strip heater according to the present invention will be described. When power is applied across the terminal sections 23a through lead wires (not shown) coupled to the conductive layers 25, the heating section 23a generates heat. The heat generated depends on the resistance of the strip heater element 23. The heat is transferred to the protection layer 24. However, the terminal sections 23b do not generate much heat because the terminal sections 23b have a relatively large width and are covered with the conductive layers 25, which also have good thermal conductivity.

In the fourth embodiment of the printed strip heater, the resistance of each of the boundary sections 23c is reduced near the terminal section 23b. Thus, the heat generated in the heater becomes lower nearer the terminal section 23b. The temperature change at the boundary section 23c is extremely gentle. As a result, the boundary sections 23c are prevented from disconnection due to thermal stresses occurring therein.

Further, in the fourth embodiment of the printed strip heater, the central part of the heating section 23a is wider than the end portions of the heating section 23a. Thus, the end portions generate more heat than the central part. The heats at the end portions of the heating section 23a compensates thermal losses absorbed by the boundary sections 23c. Thus, the heat obtained at each portion of the protection layer 24 becomes uniform. Accordingly, the fourth embodiment of the printed strip heater is able to use almost the entire length of the heating section 23a as the effective length of heater with uniform temperature.

Further, in the fourth embodiment of the printed strip heater, the substrate 21 is made of mullite ceramic. With the mullite ceramic substrate the thermal conductivity is reduced to about one half of that of a conventional alumina ceramic substrate. Thus, the thermal loss is reduced though no glaze layer is provided. Therefore, the heater can reach a sufficient temperature within a very short time after the power has been supplied. Further as the surface of the substrate 21 is formed in an uneven condition, the heating element 23 is stiffly engaged to the substrate 21. This stiff engagement also prevents the disconnection of the heating section 23a. It has been learned that the depth of the fine depressions on the uneven surface should be less than 10 μ.

The following table is a result of tests carried out for examining the fourth embodiment of the printed strip heater as to the disconnection of the heating section 23a. The test was conducted by supplying a pulsating power of 140 V, 50 Hz. The power was applied at 400 W in total for one hour. For the purpose of comparison, samples I according to the fourth embodiment and other samples II which have a straight shape heating section were tested under the same conditions.

| | Samples II | Sample I |
|---|---|---|
| Number of Disconnections | 6 | 1 |

Figure 11:
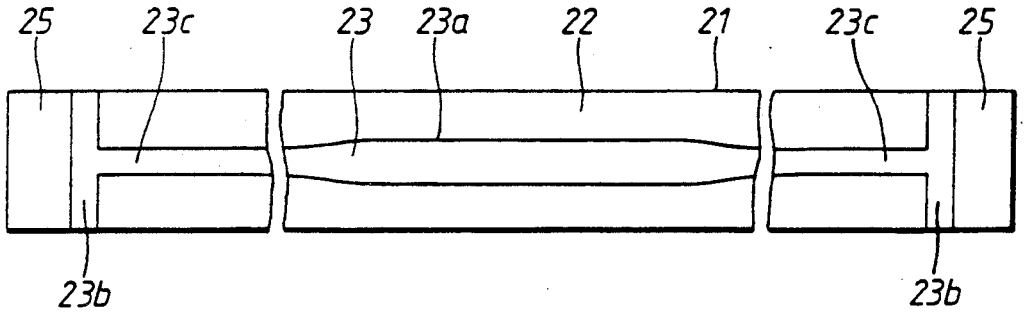
FIG. 11 is a plan view of the fifth embodiment of the printed strip heater for heating an object according to the present invention.
Figure 12:
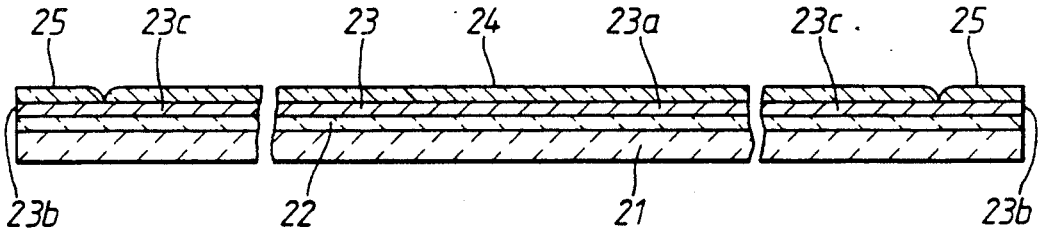
FIG. 12 is a cross-sectional view of the printed strip heater for heating an object shown in FIG. 11.
Figure 13:
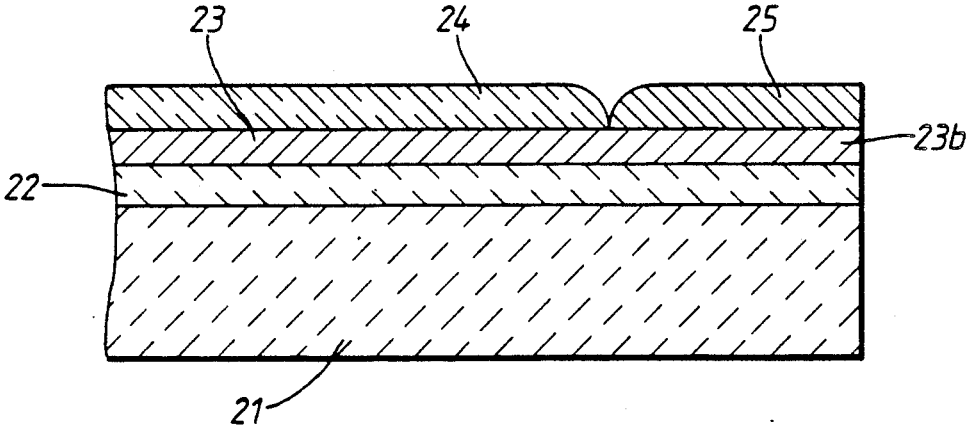
FIG. 13 is an enlarged cross-sectional view of the printed strip heater for heating an object shown in FIG. 11.

It can be seen from the table that the fourth embodiment of the printed strip heater according to the present invention is particularly excellent for preventing the disconnection of the heating element. In FIGS. 11-13 and the fifth embodiment of the printed strip heater comprises a substrate 21 made of alumina ceramic, a glaze layer 22, a strip heater element 23 and a protection layer 24 made of glass. The substrate 21 has a long and slender strip configuration, i.e., 300 mm long, 10 mm wide and 1-2 mm thick. The glaze layer 22 is coated on the substrate 21 for a thickness of around 30-150 μ. The strip heater element 23 is formed on the glaze layer 22 by a conventional thick film printing technique.

The glaze layer 22 is made of glass which has a chemical composition of $pbO.B_2O_3.SiO_2$. The $PbO.B_2O_3.SiO_2$ glass has a relatively low thermal conductivity.

The strip heater element 23 is formed on the glaze layer 22 by printing powder of silver palladium alloy according to a conventional screen printing technique and baking. The strip heater element 23 comprises a heating section 23a and a pair of terminal sections 23a. The heating section 23a has a long and slender strip configuration. Each of the terminal sections 23b has a rectangular shape. The terminal sections 23b are continuously formed adjacent both ends of the strip heater element 23. The protection layer 24 is coated so as to cover the heating section 23a and the glaze layer 22. The protection layer 24 extends over parts of the terminal sections 23b adjacent both ends of the heating section 23a. Other portions of the terminal sections 23b are coated by conductive layers 25. The conductive layers 25 are made of silver for connecting with lead wires. The silver conductive layers 25 and the protection layer 24 are baked together.

The heating section 23a is further shaped as shown in FIG. 11. In FIG. 11, the width of the heating section 23a is narrowed gradually when getting nearer the terminal sections 23b. Thus, the angle θ of a corner 23c between the heating section 23a and the terminal section 23b makes an acute angle. Therefore, portions of the heating section 23a around the corner 23c have a resistance higher than the center portion of the heating section 23a because the portions around the corners 23c are narrower than the center portion.

The operation of the fifth embodiment of the printed strip heater according to the present invention will now be described in detail.

The heating section 23a of the strip heater element 23 generates heat when power is supplied across the terminal sections 23b through lead wires (not shown) connected to the conductive layers 25. The heating operation of the heating section 23*a* quickly reaches its stable operating state, because the heating section 23*a* itself generates the heat in response to the power applied thereto. The protection layer 24 has a relatively thin thickness, e.g., about 10 μ. Thus, the heat generated by the heating section 23*a* is also transmitted quickly to the outer surface of the protection layer 24.

Further, in the fifth embodiment of the printed strip heaters, the entire length of the strip heater element 23 is covered with the protection layer 24 and the conductive layers 25. Thus, the heat generated in the heating section 23*a* of the strip heater element 23 is smoothly conducted to the protection layer 24 and the conductive layers 25. Further, the heat is transferred to the terminal sections 23*b* directly or through the protection layer 24. Thus, the temperature change along the longitudinal direction of the heater is gentle. As a result, the heating section 23*a* is prevented from the disconnecting.

Further, in the fifth embodiment of the printed strip heater, the $PbO.B_2O_3$. $SiO_2$ glass comprising the glaze layer 22 prevents heat from transferring to the substrate 21. Thus, almost all the heat generated by the heating section 23 is conducted to the protection layer 24 so that the heater has a good thermal efficiency. The thickness of the glaze layer 22 is best between 30–150 μ. If the thickness of the glaze layer 22 is less than 30 μ, the glaze layer 22 does not sufficiently prevent the heat from transferring to the substrate 21. On the other hand, if the hickness of the glaze layer 22 is larger than 150 μ, the heating section 23 is easily disconnected.

The following table is a result of tests carried out for examining the fifth embodiment of the printed strip heater as to the disconnection of the heating section 23*a*. The test was conducted by supplying a pulsating power voltage of 140 V 50 Hz. The power was applied at 400 W in total for one hour. For the purpose of comparison samples III according to the fifth embodiment and other samples IV in which the protection layer 24 is coated on only the heating section 23*a* but not on the terminal sections 23*a* were tested under the same conditions.

| | Samples IV | Sample III |
|---|---|---|
| Number of Disconnections | 7 | 1 |

It can be seen from the table that the fifth embodiment of the printed strip heater according to the present invention is particularly excellent for preventing the disconnection of the heating element.

Figure 14:
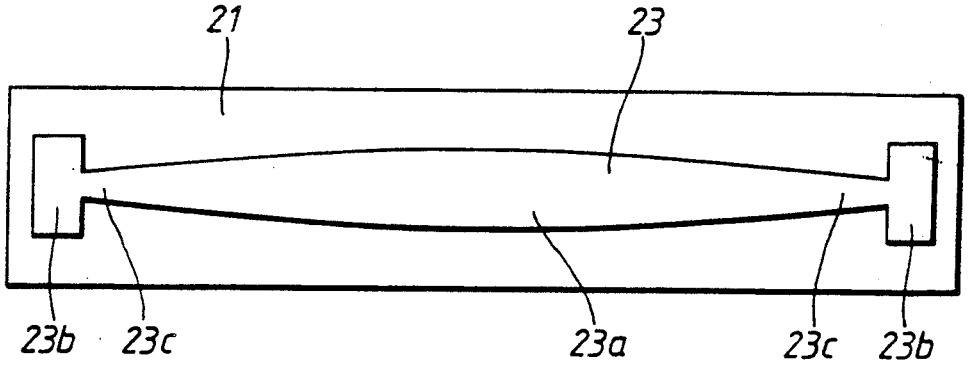
FIG. 14 is a plan view of a sixth embodiment of the printed strip heater for heating an object according to the present invention.
Figure 15:
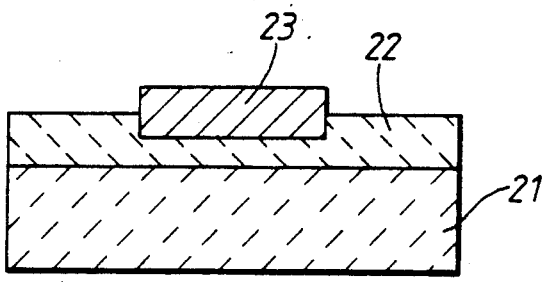
FIG. 15 is a cross sectional view of the printed strip heater for heating an object shown in FIG. 14.

In the fourth embodiment of the printed strip heater, the substrate 21 may be made of alumina ceramic. In this case, it is preferrable to provide a glaze layer on the alumina ceramic substrate. In the fifth embodiment of the printed strip heater, the substrate 21 may be made of mullite ceramic. In this case the glaze layer 22 can be omitted. In addition, the strip heater element 23 may be made of, for instance, other substances such as metal powder and or graphite, in addition to the silver-palladium alloy (Ag.Pd). Further, any material is usable for the protection layer 24 if the material is easy to coat on the strip heater element 23 and its thermal conduction is sufficient. The resistance of the end portion of the heating section 23*a* may be gradually changed by adjusting the width of the portion or by changing the thickness thereof or material thereof. The resistance of the end portion of the heating section 23*a* may be changed by a stepping state design. The end portion of the heating section 23*a* can be so designed that the resistance increases and decreases alternately but is gradually reduced along the longitudinal direction toward the terminal sections 23 and 23*b*. In a sixth embodiment of the present invention shown in FIGS. 14–16, a strip heater element 23 has been narrowed in width and resistance in the longitudinal direction has been made large. In FIGS. 14 and 15, the sixth embodiment of the printed strip heater comprises a substrate 21 made of alumina ceramics, a glaze layer 22 and a strip heater element 23.

The substrate 21 is a long and slender strip configuration, being 300 mm long, 10 mm wide and 3–5 mm thick. The strip heater element 23 is coated on the glaze layer 22 by printing powder of silver palladium alloy according to a conventional screen printing technique and baked. The strip heater element 23 has a length of 230 mm. The strip heater element 23 comprises a heating section 23*a* and a pair of terminal sections 23*a*.

The heating section 23*a* has a long and slender strip configuration. Each of the terminal sections 23*b* has a rectangular shape. The terminal sections 23*b* are provided for connection with lead wires 26. The heating section 23*a* is coupled to the terminal sections 23*b* through its end portions 23*d*. The width of each of the end portions 23*d* gradually decreases in the longitudinal direction toward the terminal sections 23*a*, as shown in FIG. 14.

The strip heater element 23 is made of a silver palladium alloy. The silver palladium alloy is coated on the glaze layer 22 in a uniform thickness over its entire portion, i.e., the heating section 23*a* and the terminal sections 23*b*, by a conventional thick film technique and baked. The cental portion of the heating section 23*a* has a maximum width of 1.5 mm. Each of the end portions 23*d* has a minimum width of 1.0 mm. Thus, the cental portion of the heating section 23*a* has a small resistance. While each of the end portions 23*d* has a large resistance. The resistance of the heating section 23*a* gradually changes over the central portions and the end portions 23*d*.

The operation of the sixth embodiment of the printed strip heater according to the present invention will now be described in detail.

The heating section 23*a* of the strip heater element 23 generates heat when power is supplied across the terminal sections 23*b* through the lead wires 26. The heating operation of the heating section 23*a* quickly reaches its stable operating state, because the heating section 23*a* itself generates the heat in response to the power applied thereto. The heat is generated at every portion of the strip heater element 23 according to the typical formula of $I^2 \cdot R$, where I is the current flowing in the portion, and R is the resistance of the portion.

Therefore, more heat is generated at the end portions 23*d* which have the high resistance than the central portion of the heating section 23*a* which has the low resistance. If the width of heating section 23*a* is uniform over the entire length, each portion of the heating section 23*a* generates heat uniformly. However, the heat generated at the end portions 23*d* of the heating section 23*a* is easily absorbed by the terminal sections 23*b* of the strip heater element 23. The temperature of the end portions 23*d* of the heating section 23*a* becomes lower than the temperature of the central portion of the heating section 23*a* in this case.

According to the sixth embodiment of the printed strip heater, the end portions 23*d* of the heating section 23a generate more heat than the central portion of the heating section 23a. The heat at the end portions 23d and 23d of the heating section 23a compensates for the thermal loss caused by the terminal sections 23a. Thus, the heat obtained at each portion of the heating section 23a becomes uniform. Accordingly, the sixth embodiment of the printed strip heater is able to use almost the entire length of the heating section 23a as the effective length of heater with uniform temperature.

Figure 16:
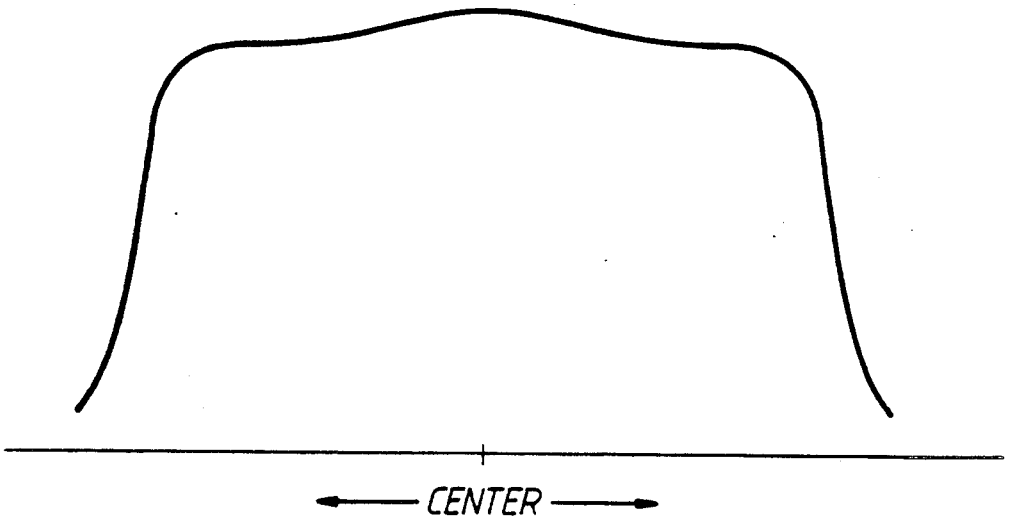
FIG. 16 is a temperature distribution diagram showing the operation of the printed strip heater for heating an object shown in FIG. 14.

The temperature change along the heating section 23a is graphically shown in FIG. 16. As clearly seen from the graph in FIG. 16, the sixth embodiment of the strip heater element has a uniform temperature distribution over almost the entire length of the heating section 23a. If the printed strip heater is designed to have a temperature of around 250 ° C., the printed strip heater may be used in copying machines for fixing toner images on papers. In this case, a paper with the image is heated over its width corresponding to almost the entire length of the heating section 23a. Further, failing of the image fixing around the end portions 23d and/or burning of the paper around the central portion of the heating section 23a are prevented. In a seventh embodiment of the present invention shown in FIGS. 17–18, a heating section 23a comprises two low resistance zones 23e and three high resistance 23f. The low resistance zones 23e and the high resistance zones 23f alternate with each other in the longitudinal direction of the heating section 23a, but one of the high resistance zones 23f is positioned at the center of the heating section 23a. Thus, low and high resistance zones alternate with each other in the longitudinal direction of a heating section 23a of the strip heater element 23. Other portions or elements are the same as the sixth embodiment of the printed strip hearer shown in FIG. 14.

The high resistance zones 28f are made of a silver palladium alloy having a sheet resistance of 40 mΩ. The low resistance zones 23e are made of a silver palladium alloy having a sheet resistance of 30 mΩ. These high and low resistance zones 23f and 23e are formed by printing ribbons of the silver palladium alloys.

Figure 17:
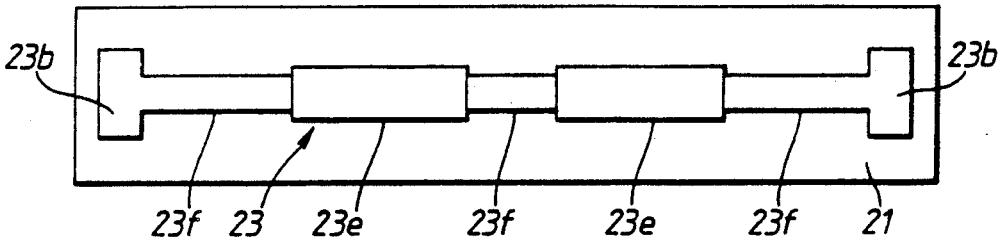
FIG. 17 is a plan view of a seventh embodiment of the printed strip heater for heating an object according to the present invention.

According to the seventh embodiment shown in FIG. 17, the temperature change along the heating section 23a is reduced as compared to the sixth embodiment as shown in FIGS. 14–16.

Figure 18:
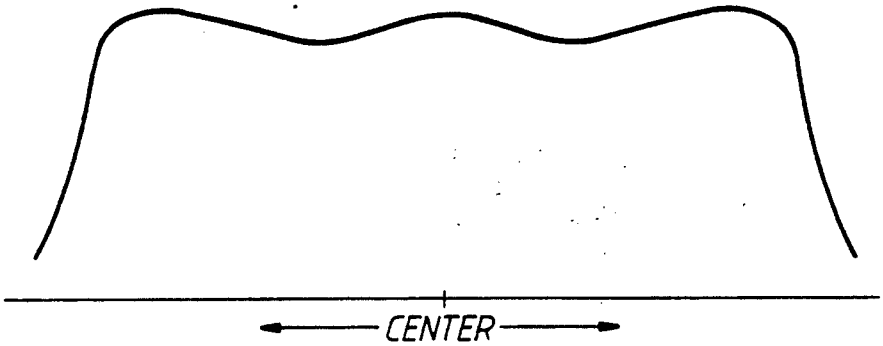
FIG. 18 is a temperature distribution diagram showing the operation of the printed strip heater for heating an object shown in FIG. 17.
Figure 19:
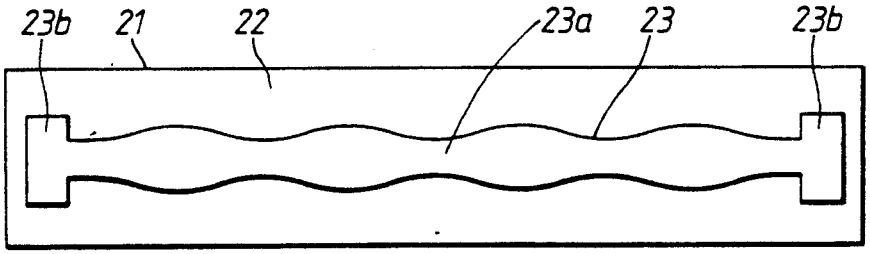
FIG. 19 view of an eighth embodiment of the printed strip heater for heating an object according to the present invention.

The temperature change along the heating section 23a in the seventh embodiment of the printed strip heater is graphically shown in FIG. 18. As is clearly seen from the graph in FIG. 18, the seventh embodiment of the strip heater element has a uniform temperature distribution over almost the entire length of the heating section 23a. The uniformity of the temperature distribution is improved over than that of the sixth embodiment as shown in FIG. 16. In an eighth embodiment of the present invention shown in FIGS. 19–20, both longitudinal edges of a strip heater element 23 are waved, as shown in FIG. 19. Thus, wide and narrow portions alternate with each other in the longitudinal direction of a heating section 23a of the strip heater element 23. Other portions or elements are the same as the sixth and seventh embodiments of the printed strip heater shown in FIGS. 14 and 17.

According to the eighth embodiment shown in FIG. 19, the temperature change along the heating section 23a is further reduced compared to the seventh embodiment as shown in FIGS. 17–18.

Figure 20:
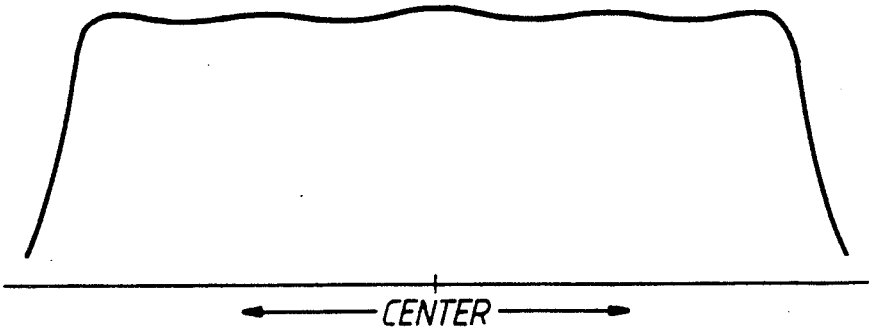
FIG. 20 is a temperature distribution diagram showing the operation of the printed strip heater for heating an object shown in FIG. 19.

The temperature change along the heating section 23a in the eight embodiment of the printed strip heater is graphically shown in FIG. 20. As clearly seen from the graph in FIG. 20, the eighth embodiment of the strip heater element has a uniform temperature distribution over almost the entire length of the heating section 23a. The uniformity of the temperature distribution is improved from that of the seventh embodiment shown in FIGS. 17–18.

In each of the sixth, seventh and eighth embodiments of the printed strip heater, the resistance of the strip heater element 23 in the longitudinal direction is locally differentiated in order to make local temperatures of the heating section 23a uniform. Thus, a desirable temperature distribution is obtained.

The present invention is not limited to the embodiments as described above. Many applications will become effective according to the present invention.

As described above, the present invention can provide an extremely preferable printed strip heater.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. A printed strip heater for heating an object comprising:

a heat resistive substrate;

a strip of electrically conductive material mounted on the substrate having a first end and a second end; and means for providing electrical energy to the strip electrically connected to the first and second ends, wherein a width of the strip is reduced near the means for providing electrical energy.

2. A printed strip heater for heating an object as in claim 1, and further comprising a glaze layer between the substrate and the strip.

3. A printed strip heater for heating an object as in claim 2, wherein the glaze layer comprises glass.

4. A printed strip heater for heating an object as in claim 1, and further comprising a protection layer formed over the strip and the substrate.

5. A printed strip heater for heating an object as in claim 4, wherein the protection layer forms a round surface over the strip and substrate.

6. A printed strip heater for heating an object as in claim 4, wherein the protection layer has better heat conduction than the substrate, so that heat generated by the strip is conducted to the surface of the protection layer.

7. A printed strip heater for heating an object as in claim 4, wherein the protection layer comprises glass.

8. A printed strip heater for heating an object as in claim 1, and further comprising a glaze layer between the substrate and the strip and a protection layer over the strip and the glaze layer.

9. A printed strip heater for heating an object as in claim 1, wherein the strip comprises a silver palladium alloy.

10. A printed strip heater for heating an object as in claim 1, wherein the strip comprises a ruthenium oxide.

11. A printed strip heater for heating an object as in claim 1, wherein the means for providing electrical energy to the strip comprises silver terminal sections.

12. A printed strip heater for heating an object as in claim 1, wherein the strip is tapered in width from a center of the strip to the means for providing electrical energy.

13. A printed strip heater for heating an object as in claim 1, wherein a width of the strip alternates between a minimum and a maximum a plurality of times along a length of the strip.

14. A printed strip heater for heating an object as in claim 1, wherein the strip comprises a plurality of segments of varying electrical resistance.

15. A printed strip heater for heating an object as in claim 1, wherein the strip and the means for providing electrical energy are constructed of the same electrically conductive material.

16. A printed strip heater for heating an object as in claim 1, wherein the substrate comprises at least one of the group of alumina ceramic, porcelain ceramic and mullite ceramic.

17. A printed strip heater for heating an object as in claim 1, wherein a surface of the substrate upon which the strip is mounted is uneven.

18. A printed strip heater for heating an object as in claim 1, wherein the strip comprises at least one of the group of metal powder and graphite.

19. A printed strip heater for heating an object comprising:

a heat resistive substrate;

a strip of electrically conductive material mounted on the substrate having a first end and a second end, the strip including a mixture of a silver palladium alloy and a ruthenium oxide; and means for providing electrical energy to the strip electrically connected to the first and second ends.

20. A printed strip heater for heating an object as in claim 1, and further comprising a glaze layer between the substrate and the strip.

21. A printed strip heater for heating an object as in claim 20, wherein the glaze layer comprises glass.

22. A printed strip heater for heating an object as in claim 19, and further comprising a protection layer formed over the strip and the substrate.

23. A printed strip heater for heating an object as in claim 22, wherein the protection layer forms a round surface over the strip and substrate.

24. A printed strip heater for heating an object as in claim 22, wherein the protection layer has better heat conduction than the substrate, so that heat generated by the strip is conducted to the surface of the protection layer.

25. A printed strip heater for heating an object as in claim 22, wherein the protection layer comprises glass.

26. A printed strip heater for heating an object as in claim 19, wherein the means for providing electrical energy to the strip comprises silver terminal sections.

27. A printed strip heater for heating an object as in claim 19, wherein a width of the strip is reduced near the means for providing electrical energy.

28. A printed strip heater for heating an object as in claim 19, wherein a width of the strip is increased near the means for providing electrical energy.

29. A printed strip heater for heating an object as in claim 19, wherein the strip is tapered in width from a center of the strip to the means for providing electrical energy.

30. A printed strip heater for heating an object as in claim 19, wherein a width of the strip alternates between a minimum and a maximum a plurality of times along a length of the strip.

31. A printed strip heater for heating and object as in claim 19, wherein the strip comprises a plurality of segments of varying electrical resistance.

32. A printed strip heater for heating an object as in claim 19, wherein the strip and the means for providing electrical energy are constructed of the same electrically conductive material.

33. A printed strip heater for heating an object as in claim 19, wherein the substrate comprises at least one of the group of alumina ceramic, porcelain ceramic and mullite ceramic.

34. A printed strip heater for heating an object as in claim 19, and further comprising a glaze layer between the substrate and the strip and a protection layer over the strip and the glaze layer.

35. A printed strip heater for heating an object as in claim 19, wherein a surface of the substrate upon which the strip is mounted is uneven.

* * * * *